US008576086B2

(12) United States Patent
Vidal et al.

(10) Patent No.: US 8,576,086 B2
(45) Date of Patent: Nov. 5, 2013

(54) LIMIT SIGNAL INDICATOR AND METHOD FOR OPERATING A LIMIT SIGNAL INDICATOR

(75) Inventors: Fausto Crespo Vidal, Langenselbold (DE); Karl-Bernd Schaertner, Nidderau (DE); Dirk Klee, Niederdorfelden (DE); Thomas Karte, Bruchkoebel (DE)

(73) Assignee: Samson Aktiengesellschaft, Frankfurt (DE)

( * ) Notice: Subject to any disclaimer, the term of this patent is extended or adjusted under 35 U.S.C. 154(b) by 544 days.

(21) Appl. No.: 12/716,053

(22) Filed: Mar. 2, 2010

(65) Prior Publication Data

US 2010/0219961 A1 Sep. 2, 2010

(30) Foreign Application Priority Data

Mar. 2, 2009 (DE) ..... 10 2009 011 242

(51) Int. Cl.
*G08B 21/00* (2006.01)

(52) U.S. Cl.
USPC ..... 340/686.1; 340/635; 340/686.2; 340/686.3

(58) Field of Classification Search
USPC ..... 340/635, 686.1, 686.3, 686.2
See application file for complete search history.

(56) References Cited

U.S. PATENT DOCUMENTS 5,123,277 A * 6/1992 Gray et al. ..... 73/29.01
5,191,267 A * 3/1993 Machacek ..... 318/67
5,586,156 A * 12/1996 Gaubatz ..... 376/216
5,743,073 A * 4/1998 Paquet ..... 56/12.1
5,832,806 A * 11/1998 Nelson ..... 91/361
6,296,208 B1 * 10/2001 Franke ..... 246/220
6,317,056 B1 * 11/2001 Klumpp et al. ..... 340/870.28
6,418,778 B1 * 7/2002 Shiau ..... 73/23.23
6,484,974 B1 * 11/2002 Franke et al. ..... 246/476
6,597,290 B2 * 7/2003 Mogi ..... 340/686.1
8,096,313 B1 * 1/2012 Kah ..... 137/1
2006/0001551 A1 * 1/2006 Kraft et al. ..... 340/870.16

FOREIGN PATENT DOCUMENTS

DE 38 36 690 C1 1/1990
DE 10 2007 004 595 A1 8/2008

* cited by examiner

*Primary Examiner* — Hai Phan
*Assistant Examiner* — Peter Mehravari
(74) *Attorney, Agent, or Firm* — Schiff Hardin LLP

(57) ABSTRACT

In a limit signal indicator for determining two positions of a pneumatically operated positioning device, a position sensor detects a position of the positioning device. A first signal transmission contact, a second signal transmission contact, and a microprocessor are provided. The first and the second signal transmission contacts each output a respective electrical limit position signal, the limit position signals representing an adoption of the first and the second positions or of at least one position of the positioning device above or below a predetermined set limit value. At least one of the signal transmission contacts is connected for signal transmission so that in case of a malfunctioning of a signal transmission, the switch amplifier is capable of generating an emergency signal above a maximum limit value or below a lower limit value, and to transmit the emergency signal to an external processing location. The microprocessor, upon detecting a specific operational malfunctioning, actuating the positioning device and executing an emergency procedure according to which the same emergency signal is generated and output at the second signal transmission contact.

29 Claims, 2 Drawing Sheets

LIMIT SIGNAL INDICATOR AND METHOD FOR OPERATING A LIMIT SIGNAL INDICATOR

BACKGROUND

The preferred embodiment relates to a limit signal indicator or limit signal transmitter for determining a position such as an end position of a pneumatically operated positioning device. Limit signal indicators are often applied for safety closure valves, which can be operated pneumatically. In case of an operational malfunctioning the pneumatic power source is cut off, whereby the safety closure valve automatically, by means of stored spring energy, reaches a final safety position in which a fluid transmission line of a technical processing plant is either completely opened or completely closed by means of a valve member.

A common limit signal indicator should be capable of displaying to an operating person by means of a respective signal whether the safety signal valve is indeed in the desired end position.

For generating and transmitting signal information, a signal transmission contact is formed in the known limit signal indicator generally referred to as a Namur-sensor. A Namur-sensor is defined among others by the standard "IEC69047-5-6". If the positioning device adopts the expected end position, this adoption of position is represented via the signal transmission contact by a current signal of less than about 1.2 mA, for example about 1 mA. In case of non-adoption of the end position another specific current signal of above about 2.1 mA is given by the Namur-sensor. In order to generate these two binary switching states, a buffer amplifier can be connected to the Namur-sensor, wherein the buffer amplifier can be connected to a so-called proximity switch. The proximity switch is supplied with about 8 V and modifies the supply current to the buffer amplifier depending on the switch status according to the above named amounts, that is between the limit values 1.2 mA and 2.1 mA. If the input current for the buffer amplifier drops below a value of about 0.1 mA or if no current is supplied to the buffer amplifier, according to the standard this will be interpreted as a line breakage towards the Namur-sensor. According to the standard EN 60947-5-6 the buffer amplifier will then generate a standardized emergency signal of below 0.1 mA. If however, the buffer amplifier generates the standardized emergency signal with a current value of more than about 6 mA, a short circuit at the limit signal indicator is to be assumed. The two above-named switching states (1.2 mA; 2.1 mA) are displayed and transmitted by the buffer amplifier as standardized switch signals, wherein also two additional emergency signals, that is a short circuit signal and a line breakage signal, can be generated and transmitted.

There is a general interest in designing limit signal indicators more "intelligently" by providing the limit signal indicator with a microprocessor and a position sensor while maintaining the basic functionality as limit signal indicator.

DE 10 2006 049 651 A1 discloses such an intelligent position sensor in which the microprocessor is electrically supplied either by the above named Namur-sensor supply voltage of 7 to 8 V or by a constant voltage signal of 24 V, commonly supplying a pneumatic valve that in turn is connected to a pneumatic positioning drive. Another intelligent limit switch arrangement is known by EP 1 730 611 A1.

However, the increase of functional multiplicity of the limit signal indicator leads to the problem that in view of the restrictive safety regulations for technical processing plants, the functionality of the intelligent limit signal indicators must constantly be surveyed and malfunctioning must as far as possible be excluded.

SUMMARY

It is an object to overcome disadvantages of the prior art, in particular to improve the operational safety and reliability of a so-called intelligent limit signal indicator.

In a limit signal indicator for determining two positions of a pneumatically operated positioning device, a position sensor detects a position of the positioning device. A first signal transmission contact, a second signal transmission contact, and a microprocessor are provided. The first and the second signal transmission contacts each output a respective electrical limit position signal, the limit position signals representing an adoption of the first and the second positions or of at least one position of the positioning device above or below a predetermined set limit value. At least one of the signal transmission contacts is connected for signal transmission so that in case of a malfunctioning of a signal transmission, the switch amplifier is capable of generating an emergency signal above a maximum limit value or below a lower limit value, and to transmit the emergency signal to an external processing location. The microprocessor, upon detecting a specific operational malfunctioning, actuating the positioning device and executing an emergency procedure according to which the emergency signal is generated and output at the second signal transmission contact.

DESCRIPTION OF THE PREFERRED EMBODIMENT

Figure 1:
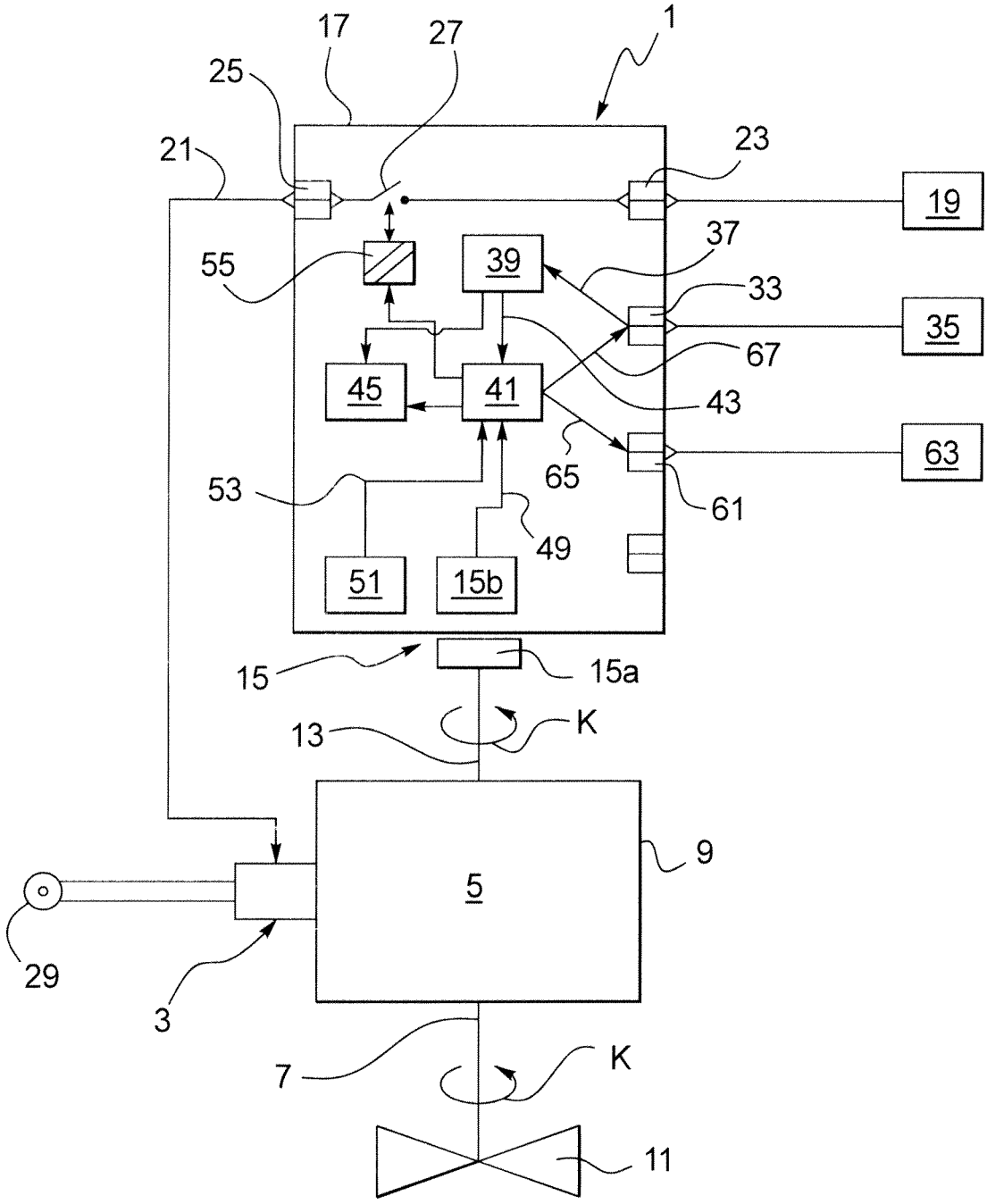
FIG. 1 is a block diagram of a first embodiment of the limit signal indicator and a pneumatically operated positioning device.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated devices and such further applications of the principles of the invention as illustrated as would normally occur to one skilled in the art to which the invention relates are included.

A limit signal indicator is provided for determining two positions, such as two end positions, of a pneumatically operated positioning device, in particular a safety valve that for example is intended to adopt a completely opened and a completely closed end position. The limit signal indicator can just as well be provided with a position sensor such as an analogue HALL-sensor or a proximity switch in order to detect the position of the positioning device, in particular its end position, preferably for a position control system. The limit signal indicator has a first signal transmission contact that for example can be designed as a first standardized Namur-sensor. Furthermore, the limit signal indicator has a second signal transmission contact that can, for example, also be designed as second standardized Namur-sensor. Finally, the limit signal indicator has a microprocessor. The limit signal indicator, in particular the microprocessor, is designed to output an electric limit position signal at the first and second signal transmission contact, respectively. The limit position signal provides information about the adoption of the first and the second position, respectively of at least one position of the positioning device different from those if the signal is above or below a predetermined set limit value that, according to the Namur specification, may be below 1.2 mA or above 2.1 mA. At least one of the two signal transmission contacts is connected in particular to a switch amplifier for transmission of the limit position signal, wherein in case of malfunctioning of the signal transmission, such as a short circuit or a line breakage, the switch amplifier is capable of generating in each case one emergency signal above a maximum limit value, such as about 6 mA, according to the Namur specification, or below a lower limit value, such as 0.1 mA, according to the Namur specification, and to transmit the respective emergency signal to an external processing location, such as a control room. By means of the multiplication of the Namur-sensors the limit signal indicator according to the preferred embodiment provides at least four additionally assignable position signals, that is two additional limit position signals and two additional emergency signals (short circuit and line breakage), and these signal types can be used, in particular via the microprocessor, to also display other operating states than those that are actually generated for according to the Namur specification. According to the preferred embodiment, upon detecting a specific operational malfunctioning of the limit signal indicator, the positioning device and/or a drive actuating the positioning device, the microprocessor may execute an emergency procedure for the additional signal transmission contact according to which the defined "emergency signal" (below 0.1 mA, second contact; above 6 mA, second contact; etc.) is generated and output at the additional signal transmission contact. This emergency signal actually indicates a short circuit or line breakage but is used according to the preferred embodiment to indicate any predefined operating state.

Thus, according to the preferred embodiment, the microprocessor is electrically connected to the second or further signal transmission contacts such that upon detection of a specific predefined operational state of the limit signal indicator, the positioning device and/or one of the drives actuating the positioning device, i.e. in case of an operational malfunctioning that is different from a line fault, the microprocessor executes an emergency procedure according to which the typical emergency signal as in case of a line fault, such as above about 6 mA or below about 0.1 mA, is generated and output at the second or further signal transmission contacts, wherein the recipient of the emergency signal is capable of interpreting the latter, i.e. knows that this typical emergency signal is also generated if the specific operating state is present.

The idea of the preferred embodiment is essentially that the typical emergency signals prescribed by the standard EN 60947-5-6—in the case of a line breakage or short circuit of the line—are output as another specific error indication signal in order to indicate a more or less frequent malfunctioning not only of the limit signal indicator but also of the components connected to it such as a positioning device or pneumatic drive. The limit signal indicator according to the preferred embodiment requires the provision of a second signal transmission contact because the microprocessor should preferably be electrically supplied exclusively via the first signal transmission contact. An emergency signal output to the first signal transmission contact for transmitting information about other operating states or a line fault cannot be proceeded insofar as this would also entail a rupture of the energy supply to the microprocessor.

If the limit signal indicator outputs an end position signal of for example below 1.2 mA or above 2.1 mA at the second signal transmission contact and simultaneously an operational malfunctioning was detected, requiring output of an actual true emergency signal via the second signal transmission contact, it can be provided according to the preferred embodiment, that the superordinate emergency signal overwrites the position signal.

For an alternative subject of the preferred embodiment, which however can be combined with the aspect of the preferred embodiment given above, the preferred embodiment relates to a limit signal indicator for determining two positions, such as two end positions, of a pneumatically operated positioning device. The limit signal indicator has a position sensor for detecting the position of the positioning device, a first signal transmission contact, especially a first Namur-sensor, a second signal transmission contact, especially a second Namur-sensor and a microprocessor. The limit signal indicator according to the preferred embodiment is designed for outputting a first electric limit position signal at the first and the second signal transmission contact, respectively. These limit position signals indicate the adoption of the first and the second position or of at least one position of the positioning device different thereto and in particular slightly above or below a predetermined set limit value, such as above or below 1.2 mA or 2.1 mA, respectively. At least one of the signal transmission contacts is connected in particular with a switch amplifier for transmitting signals, the switch amplifier being suitable in case of a malfunctioning of the signal transmission, such as a short circuit or a line breakage, to generate an emergency signal above an upper limit value, such as for example 6 mA, or below a lower limit value, such as 0.1 mA, and to transmit the emergency signal to an external processing location, such as a control room. According to the preferred embodiment, the signal limit indicator has a third signal transmission contact, especially a third Namur-sensor and, if applicable, further signal transmission contacts, especially further Namur-sensors if applicable. Therein, upon detecting a specific operational malfunctioning of the limit signal indicator, the positioning device and/or the drive actuating the positioning device, the microprocessor executes an emergency procedure with respect to the third signal transmission contact, according to which an alarm signal assigned to this operational malfunctioning is generated and output at the third and, if applicable, a further signal transmission contact. The alarm signal can be formed by utilizing one of the four typical signal types of the third or further Namur-sensors. Thereby this operational malfunctioning is indicated clearly by one of the typical Namur signals above or below a predetermined set limit value, such as below about 1.2 mA or above 2.1 mA, or above the upper limit value, such as about 6 mA, or below the lower limit value such as about 0.1 mA. With this aspect of the preferred embodiment, by means of a simple method four or more (a multiple of four additional individual signals) additional information switching states, smaller than 1.2 mA, larger than 2.1 mA, smaller than 0.1 mA, larger than 6 mA, are created that can be used to represent general malfunctioning or specific operating states of the limit signal indicator or the connected components. Preferably the first and second signal transmission contacts are not fed the emergency signals. The first and second signal transmission contact can be used for providing the exclusive power supply for the microprocessor.

The preferred embodiment also relates to an arrangement comprising a limit signal indicator and a switch amplifier connected to the respective limit signal contact.

In the preferred embodiment, the microprocessor is supplied with electric power exclusively via the first, second or third signal transmission contact or, if applicable, only via a further signal transmission contact.

In a further development of the preferred embodiment, the microprocessor is connected via a cable line with the first, with the second and/or with the third signal transmission contact and/or, if applicable, with further signal transmission contacts such that the emergency or alarm signal generated by the microprocessor can be conducted to the respective signal transmission contact.

Preferably, the microprocessor, in particular the limit signal indicator is driven by only one constant supply voltage, in particular of about 7 to 8 V, that is conducted to one or several signal transmission contacts.

In the preferred embodiment, the signal limit indicator features an operating element that can be actuated by an operating person in order to adjust positioning parameters for the limit signal indicator at the microprocessor, in particular to activate diagnosing routines, etc.

Preferably, a second microprocessor is provided, which is disposed between the operating element and the first microprocessor.

In a further embodiment, the signal limit indicator has an enclosed housing in which, beside the microprocessor, also an electro-pneumatic converter (I/P-converter), in particular a magnetic valve, is received, wherein the housing has a pneumatic input to be connected to a pneumatic source and an output for pneumatic coupling to the positioning drive. Therein the I/P-converter can be connected at the output side at the inside of the housing.

In the preferred embodiment, a device for detecting a voltage signal generated by the microprocessor, provided for the I/P-converter is provided, wherein the measured voltage signal is designed to indicate the operational state of the I/P-converter. The voltage signal can be visualized on a display at the outside of the signal indicator.

In the preferred embodiment, the microprocessor for differentiating emergency or alarm signals is suitable to clock the in particular standardized emergency or alarm signal in a frequency specific manner in order to output at the respective signal transmission contact an electrical signal that is distinctively identifiable with respect to the detected operational malfunctioning.

Furthermore, the preferred embodiment relates to a method for operating a limit signal indicator for determining two positions, such as two end positions, of a pneumatically operated positioning device, wherein, respectively, an electric position limit signal is output at a first signal transmission contact, in particular at a first Namur-sensor, and at a second signal transmission contact, in particular at a second Namur-sensor, when one of the positions or at least one position of the positioning device differing therefrom is adopted. Both position limit signals represent the respective positions by outputting a current signal above or below a predetermined set limit value, such as below 1.2 mA or above 2.1 mA. At least one of the signal transmission contacts is connected in particular to a switch amplifier for signal transmission which, in case of a malfunctioning of the signal transmission such as a short circuit or a line breakage, is suitable for generating an emergency signal above an upper limit value, such as 6 mA or an emergency signal below a lower limit value, such as 0.1 mA, and for transmitting the respective emergency signal to an external processing location, such as a control room. According to the preferred embodiment, upon detection by the microprocessor of an operational malfunctioning of the limit signal indicator different from a short circuit or a line breakage, the positioning device and/or a drive actuating the positioning device, an emergency procedure is executed by the microprocessor according to which an emergency signal is generated in the above named typical form and output at the second signal transmission contact.

Furthermore, the preferred embodiment relates to a method for operating a limit signal indicator for determining two positions, such as two end positions, of a pneumatically operated positioning device, wherein, respectively, an electric position limit signal is output at a first signal transmission contact, in particular a first Namur-sensor and to a second signal transmission contact, in particular a second Namur-sensor, when one of the positions or at least one position of the positioning device different therefrom is adopted. Both position limit signals represent the respective position by outputting a current signal above or below a predetermined set limit value, such as below about 1.2 mA, or above about 2.1 mA. At least one of the signal transmission contacts is connected in particular to a switch amplifier for signal transmission that, in case of a malfunctioning of the signal transmission such as a short circuit or a line breakage, is suitable for generating an emergency signal above an upper limit value, such as 6 mA, or an emergency signal below a lower limit value, such as 0.1 mA, and to transmit the respective emergency signal to an external processing station such as a control room. According to the preferred embodiment, upon detection of an operational malfunctioning of the limit signal indicator different from a short circuit or a line breakage, the positioning device and/or one of the drives actuating the positioning device, the microprocessor executes an emergency procedure according to which a typical alarm or emergency signal is generated and outputted at a third or, if applicable, further signal transmission contact, which alarm signal represents the operational malfunction by means of a current either a) above or below the predetermined set limit value, such as below about 1.2 mA or above about 2.1 mA, b) above the upper limit value, such as about 6 mA, or c) below the lower limit value, such as about 0.1 mA. According to the preferred embodiment, upon detection of an operating state or operational malfunctioning of the limit signal indicator, the positioning device and/or a drive actuating the positioning device, the microprocessor executes an emergency procedure according to which a predetermined emergency signal is generated and outputted at a third or, if applicable, further signal transmission contact. The emergency signal informs about the operational malfunctioning by outputting a current signal above and below a predetermined set limit value, such as below about 1.2 mA or above about 2.1 mA, or above an upper limit such as about 6 mA or below a lower limit, such as about 0.1 mA, in particular 50 μA.

In a preferred embodiment, if an emergency signal is generated, an end position signal coincidentally destined for transmission to the second signal transmission contact will be overwritten.

It is to be understood that the method according to the preferred embodiment can be designed according to the functionality of the limit signal indicator.

Further characteristics, advantages and features of the preferred embodiment are explained by means of the following description of the preferred embodiment with reference to the enclosed drawings.

In FIG. 1 is outlined a block diagram of a limit signal indicator 1 according to the preferred embodiment with a magnetic valve 3 connected to a pneumatic positioning drive 5 for controlling the drive. The pneumatic positioning drive 5 is a pivoting drive, which is indicated by the circular arrows K. A positioning shaft 7 of the pneumatic positioning drive 5 extends through a positioning drive housing 9 to a side of the positioning drive housing 9 facing the positioning valve 11.

On the side of the positioning drive housing 9 facing away from the positioning valve 11 a positioning shaft end 13 protrudes, at which is arranged the first part 15*a* of a position sensor 15 allowing a contactless sensing of the pivoting position of the positioning shaft 7 by the second part 15*b* of the position sensor 15. The second part 15*b* of the position sensor 15 is disposed in an enclosed, intrinsically safe housing 17 of the limit signal indicator 1. The first part 15*a* is situated outside the housing 17. The position sensor can be designed as proximity switch or as an analog HALL-sensor.

The magnetic valve 3 is connected via a supply line 21 to a constant supply voltage 19 of 24 V. The supply line 21 passes into the housing 17 of the limit signal indicator 1 via an input 23 and leaves the same housing 17 at an output 25 from where it is directly connected to the magnetic valve 3. An open-/close-switch 27 for opening and interrupting the supply line 21 is disposed within the housing 17 of the limit signal indicator 1. The supply line 21 serves exclusively for supplying electric power of the magnetic valve 3.

The magnetic valve 3 is in pneumatic connection with a 6-bar-pressure supply 29 that only allows charging the pneumatic positioning drive 5 with pressure when the 24 V supply voltage 19 is also present at the magnetic valve 3. In this "normal" operating condition of the pneumatic positioning drive the positioning valve 11 is in an operating position often defined by a complete opening of a fluid line (not represented) of a processing plant. In case of a malfunctioning of the technical processing plant (not represented) the positioning valve 11 is intended to usually automatically travel into a safety position, which travelling is enacted by means of internal spring forces of the positioning drive 5.

If the 24 V power supply fails or the supply line 21 is interrupted by actuating the switch 27, the magnetic valve 3 vents the pneumatic positioning drive 5 from the pneumatic pressure source 29, so that the positioning valve 11 travels into the desired safety position by means of the spring forces.

Beside the input 23, the limit signal indicator 1 has a single power input 33 at which a constant voltage supply of 7 to 8 V is present. The constant voltage of 7 to 8 V is provided by a buffer amplifier 35. The input 33 is connected to a power supply 39 inside the limit signal indicator via a power line 37, wherein the power supply 39 can also be formed as a mains adapter. The power supply 39 receives the only operational power for all of the electric users of the limit signal indicator 1 exclusively from the buffer amplifier 35 via the power input 33.

In the block diagram of the limit signal indicator 1 two types of arrows are used, one arrow type with filled out arrow head and another arrow type with the arrow head represented as two lines. The arrows with filled out arrow heads represent the flow of electric power of the respective components of the limit signal indicator 1. The arrows with the heads represent by lines exclusively represent possible electric signal transmission processes.

The power supply 39 not only powers a micro processor 41 of the limit signal indicator 1 via a power line 43, but also a visual display 45 for operating personnel. The microprocessor 41 also receives position signals of the positioning shaft 7 from the position sensor 15 via a communication line 49. Furthermore, from an operating element 51 the microprocessor receives functional parameters, such as the definition of the end contacts to be determined by the limit signal indicator 1, activation signals for proceeding with diagnosis, etc. The operating element 51 can be designed as rotary knob or push button switch and is manually operable from outside the housing 17 of the limit signal indicator. As represented in FIG. 1, a communication line 53 exists between the operating element 51 and the microprocessor 41.

Furthermore, the microprocessor 41 is connected to the open-/close switch 27 via an opto-coupler 55. By means of the opto-coupler 55, the microprocessor can switch the magnetic valve during start-up or for the purpose of further diagnosis, for example in order to detect the end positions, determine delay or running times. Further, a failure of the power supply of the limit signal indicator at connection 33 will not affect the signal supply of the magnetic valve.

If the positioning valve 11 is in a normal operating situation, i.e. the magnetic valve 3 allows a pneumatic pressure of 6 bar in the pneumatic drive 5, so that an autonomous, spring driven displacement of the magnetic valve into the closed position is prevented, the "normal" operating position of the positioning valve 11 is detected by the position sensor 15 and a respective position signal is transmitted to the microprocessor 41 via the communication line 49. According to the positioning signal the microprocessor 41 outputs a signal below 1.2 mA via the communication line 65 and a signal above 2.1 mA via the communication line 67, whereby respective binary limit signal contacts can be sensed, according to which the positioning valve is in the normal operating position and not in the emergency position.

If a dangerous malfunctioning occurs in the technical processing plant in that the magnetic valve 3 is not supplied by 24 V anymore and the pneumatic drive 45 is vented, the positioning valve 11 is pivoted into its emergency position which is then detected by the position sensor 15 and communicated to the microprocessor 41. By means of the power supply, via the buffer amplifier 35 the microprocessor 41 outputs respective position signals to the inputs 33, 61, whereby again a current signal below 1.2 mA can be sensed at the one connection 61 as well as a 2.1 mA signal can be sensed at the other connection 31. In this way, it is possible to redundantly determine the exact position of the positioning valve even when the power supply by 24 V is interrupted.

The limit signal indicator 1 has a further signal input 61 connected to an additional buffer amplifier 63 feeding a constant voltage signal of 7 to 8 V to a signal input 61. The signal inputs 33, 61 as well as the buffer amplifiers 35, 63 connected thereto are known as so-called Namur-sensors. The signal input 61 does not serve as a power supply for electrical consumers of the limit signal indicator 81 but for only for generating and outputting a binary information signal concerning the functionality of the limit signal indicator 1.

The microprocessor 41 outputs binary signals to a control room (not represented) via both inputs 33, 61 in order to specify whether the positioning valve 11 is situated in the predefined limit position. Via the inputs 33, 61 currents of either less than 1.2 mA or more than 2.1 mA are generated, which correspond to the two different binary states.

Should a line breakage, respectively, a short circuit of the line occur within the limit signal indicator 1, a buffer amplifier 35 is designed to detect an emergency signal in the form of a current signal below 3.1 mA, respectively larger than 6 mA, and to output this alarm to the control room.

The microprocessor 41 is designed to signal another malfunctioning at the limit signal indicator 1, i.e. a malfunctioning other than line breakage or short circuit of the line, or also operational malfunctioning at the positioning valve 11 or at the pneumatic positioning drive 5, etc. This is achieved by in fact utilizing the typical Namur emergency signal at the second signal input 61 via the communication line 65, which emergency signal actually corresponds in its amount and signal structure to the emergency signal at signal input 33 referring to line breakage and short circuit of the line, yet by co-opting the emergency signal for indicating another, defined or undefined operational malfunctioning. In this way, it is displayed to an operating person or the control room that a defined and possibly faulty operating state is present at the total arrangement. Subsequently a diagnosing routine can be initiated by the microprocessor 41 or another logic unit in order to determine the cause of the fault.

The limit signal indicator 1 can also diagnose its own functionality and/or the functionality of the magnetic valve 3 as well as the pneumatic positioning drive 5 and the positioning valve 11. According to an external control via the operation element 51 or by means of autonomously initiated routines the microprocessor 41 can execute a diagnosing procedure by opening for a short period the open-/close-switch 27 via the opto-coupler 55. In this way, the magnetic valve 3 is vented, whereby the positioning valve 11 travels from the normal position to the closed position. By means of the microprocessor 41, which is continued to be powered, the desired closed position of the positioning valve 11 can be verified.

Figure 2:
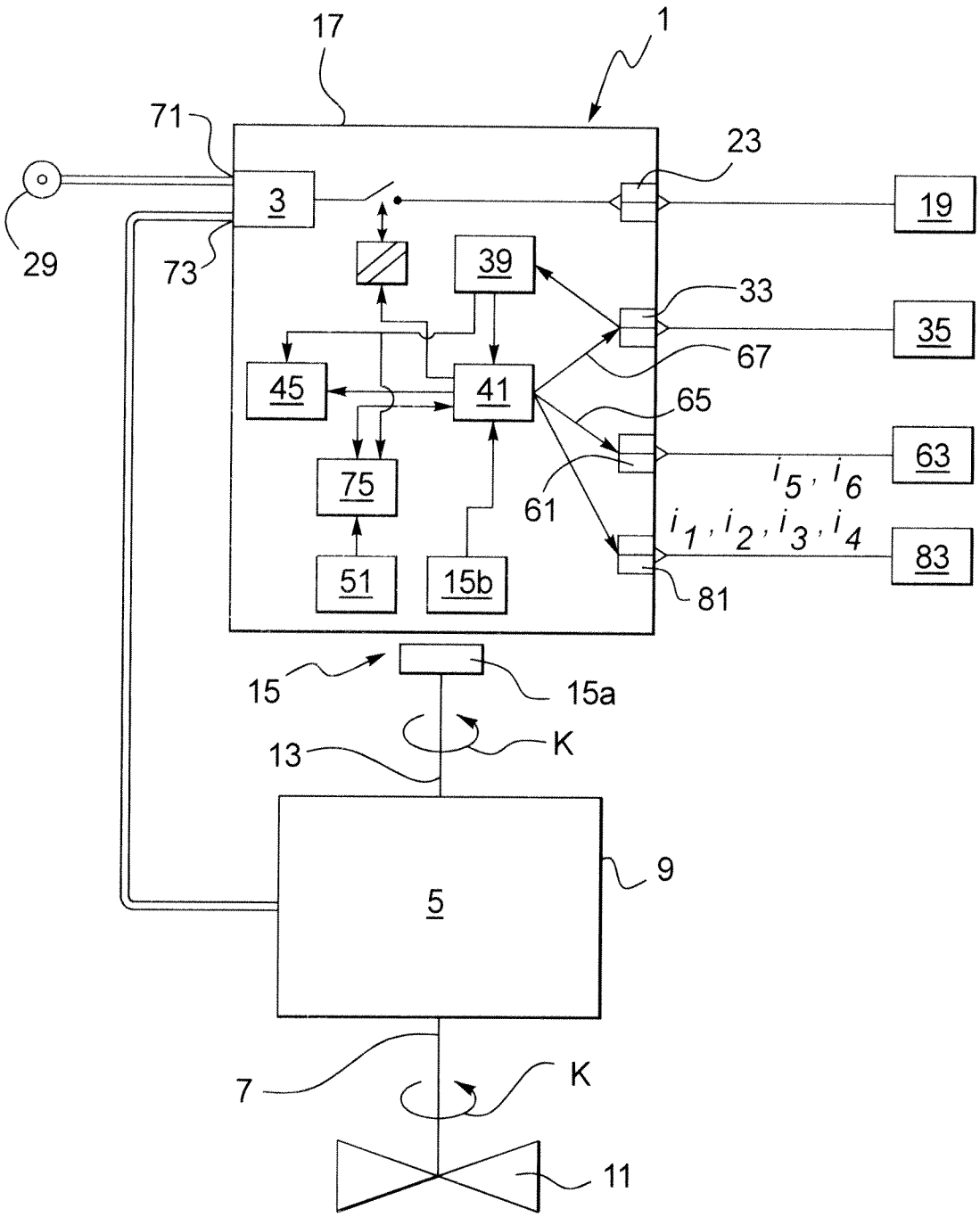
FIG. 2 is a block diagram of a second embodiment of a limit signal indicator and a pneumatically operated positioning device.

In FIG. 2 a further embodiment is shown, wherein identical reference numerals are used for similar or identical structural or functional components. The arrangement according to FIG. 2 differs from the one according to FIG. 1 in that the magnetic valve 3 is disposed inside the enclosed housing 17 of the limit signal indicator. Insofar the housing 17 has a pneumatic input 71 as well as a pneumatic output 73 connected to a pneumatic positioning drive 5. In this way a compact, intelligent limit signal indicator structure with the magnetic valve 3 can be provided. This design can also be incorporated in the embodiment shown in FIG. 1. Furthermore, the embodiment according to FIG. 2 has a second microprocessor 75 that also is powered by the power supply 39. The second microprocessor 75 receives data from the first microprocessor 41 as well as transmits parameter data to the first microprocessor 41. The second microprocessor 35 is connected to the operating element 51. The second microprocessor 75 serves for querying the operating element 51 and is transferred into a low power sleep mode if the operating element 51 is not actuated. In this way, the power requirement of the limit signal indicator 1 is low.

The embodiment according to FIG. 2 is further provided with a fourth electric input 81 connected to an external switch amplifier 83 providing a 7 to 8 V power supply to the signal input 81. This supply voltage serves only for the signal transmission and not as power supply to the consumers of the limit signal indicators 1.

Four individual signals $i_1$, $i_2$, $i_3$ and $i_4$ can be output via the third signal input 81, that is a first current signal $i_1$ smaller than 1.2 mA, a second current signal $i_2$ larger than 2.1 mA, a third current signal $i_3$ smaller than 0.1 mA and a fourth current signal $i_4$ larger than 6 mA. Thus, normalized Namur-sensor signals are provided at the third signal input in order to signal various operational malfunctioning statuses individualized with respect to each other. Thereby the microprocessor 41 can be programmed such that for each individual operational malfunctioning it generates and outputs a respective individual signal $i_1$, $i_2$, $i_3$ and $i_4$.

At the second signal input 61 also two further emergency signals $i_5$, $i_6$ can be output for transmitting individualized information, which are defined by a current signal smaller than 0.1 mA and larger than 6 mA.

Thus, in the embodiment of the limit signal indicators 1 shown in FIG. 2, six additional operating states can be output via the Namur-sensors 61, 63, 81, 83, and their provided current signals $i_1$ to $i_6$. Furthermore the "classical" Namur-sensors 33, 35, 65, 63, are suitable for indicating the adoption or non-adoption of the end position of the positioning valve as well as line breakage and short circuit of the line.

Should one of the emergency signals be present at the signal input 33, 65, 81, then a diagnosing routine can be executed by the microprocessors 41, 75 in order to ponder the cause of the fault.

In order to enable signaling of still further individualized operating. states, the individual emergency signals $i_1$ to $i_6$ can be individualized by a respective clocking and change of frequency.

It shall be understood that the power supply of the consumers of the limit signal indicator 1 is exclusively realized via the power supply input 23 and thus via the switch amplifier 35 providing a constant voltage of 7 to 8 V to the power input 33.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A limit signal indicator for determining first and second positions of a pneumatically operated positioning device actuated by a positioning drive, comprising:

a position sensor for detecting a position of the positioning device;

a first signal transmission contact, a second signal transmission contact, and a microprocessor connected to the first and second contacts by respective communication lines;

the first signal transmission contact outputting a first electrical limit position signal indicating that the positioning device is in the first or the second position and the second signal transmission contact outputting a second electrical limit position signal different than said first electrical limit position signal indicating that the positioning device is in the first or the second position, or the first and the second electrical limit position signals indicating a position of the positioning device different than the first and the second position, and wherein when one of said first and second limit position signals is above a respective first predetermined set limit value and the other of said first and second limit position signals is below a respective second predetermined set limit value the positioning device is identified as being in said respective first or second position;

the first signal transmission contact being connected to a respective first switch amplifier and the second signal transmission contact being connected to a respective second switch amplifier;

the first switch amplifier generating and transmitting to an external processing location a first emergency signal in case of a signal transmission malfunctioning within the limit signal indicator of a signal transmission of at least one of said first and second electrical limit position signals, said first emergency signal having a value above a maximum limit value or below a minimum limit value; and upon detecting by said microprocessor a specific operational malfunctioning of the limit signal indicator, the positioning device, or the positioning drive, or a combination thereof, said specific operational malfunctioning being other than said signal transmission malfunctioning, said microprocessor executing an emergency procedure according to which a second emergency signal is generated and transmitted by said second switch amplifier to said external processing location, a value of said second emergency signal substantially corresponding to the value of the first emergency signal.

2. The limit signal indicator of claim 1 wherein said second emergency signal corresponds in signal structure to said first emergency signal.

3. The limit signal indicator of claim 1 wherein said malfunctioning of the signal transmission is caused by a line breakage or short circuit of at least one of said communication lines.

4. The limit signal indicator of claim 1 wherein said first and second positions are end positions.

5. The limit signal indicator of claim 1 wherein said pneumatically operated positioning device comprises a valve.

6. The limit signal indicator according to claim 1 wherein the microprocessor is electrically powered exclusively via the first, the second, or a third signal transmission contact.

7. The limit signal indicator according to claim 1 wherein the microprocessor is driven by only one constant supply voltage present at at least one of the signal transmission contacts.

8. The limit signal indicator according to claim 1 wherein the limit signal indicator has positioning parameters and wherein an operating element is provided that is actuated by an operation person in order to adjust the positioning parameters for the limit signal indicator at the microprocessor.

9. The limit signal indicator according to claim 8 wherein a further microprocessor is provided disposed between the operating element and the microprocessor.

10. The limit signal indicator according to claim 1 wherein an enclosed housing is provided in which, an electro-pneumatic I/P converter along with the microprocessor are enclosed, an electrical input connected to the microprocessor, a pneumatic input of the electro-pneumatic I/P converter connected to a pneumatic source, and a pneumatic output of the electro-pneumatic I/P converter connected to said positioning drive.

11. The limit signal indicator according to claim 1 wherein an electro-pneumatic I/P converter is provided having an electrical input for detecting a voltage signal generated by the microprocessor, the detected voltage signal indicating an operational state of the I/P converter, the detected voltage signal being visualized on a display at an outside of the limit signal indicator, and said converter having a pneumatic output connected to said positioning drive and a pneumatic input connected to a pneumatic source.

12. The limit signal indicator according to claim 1 wherein the microprocessor, for differentiating at least one of the first and second emergency signals, clocks the at least one emergency signal in a frequency specific manner so that the at least one emergency signal is identifiable with respect to a detected operational malfunctioning.

13. The limit signal indicator according to claim 1 wherein if the second emergency signal is generated, an end position signal corresponding to said second electrical limit position signal at the second signal transmission contact is replaced by a signal for generating said second emergency signal at an output of said second switch amplifier.

14. The limit signal indicator of claim 1 wherein the first and the second signal transmission contacts each comprises a Namur sensor.

15. A limit signal indicator for determining first and second positions of a pneumatically operated positioning device actuated by a positioning drive, comprising:

a position sensor for detecting a position of the positioning device;

a first signal transmission contact, a second signal transmission contact, a third signal transmission contact, and a microprocessor connected to the first, second, and third contacts by respective communication lines;

the first signal transmission contact outputting a first electrical limit position signal indicating that the positioning device is in the first or the second position and the second signal transmission contact outputting a second electrical limit position signal different than said first electrical limit position signal indicating that the positioning device is in the first or the second position, or the first and the second electrical limit position signals indicating a position of the positioning device different than the first and the second positions, and wherein when one of said first and second limit position signals is above a respective first predetermined set limit value and the other of said first and second limit position signals is below a respective second predetermined set limit value then the positioning device is identified as being in said respective first or second position;

the first signal transmission contact being connected to a respective first switch amplifier, the second signal transmission contact being connected to a respective second switch amplifier, and the third signal transmission contact being connected to a respective third switch amplifier;

the first switch amplifier generating and transmitting to an external processing location a first emergency signal in case of a signal transmission malfunctioning within the limit signal indicator of a signal transmission of at least one of said first and second electrical limit position signals, said first emergency signal having a value above a maximum limit value or below a minimum limit value; and upon detecting by said microprocessor a specific operational malfunctioning of the limit signal indicator, the positioning device, or the positioning drive, or a combination thereof, said specific operational malfunctioning being other than said signal transmission malfunctioning, said microprocessor executing an emergency procedure according to which a second emergency signal is generated and transmitted by said third switch amplifier to said external processing location, said second emergency signal representing said specific operational malfunctioning either a) above or below said predetermined first or second set limit values, b) above said maximum limit value, or c) below said minimum limit value.

16. The limit signal indicator of claim 15 wherein said malfunctioning of the signal transmission is caused by line breakage or short circuit of at least one of said communication lines.

17. The limit signal indicator of claim 15 wherein said first and second positions are end positions.

18. The limit signal indicator of claim 15 wherein said pneumatically operated positioning device comprises a valve.

19. The limit signal indicator according to claim 15 wherein the microprocessor is driven by only one constant supply voltage at at least one of the signal transmission contacts.

20. The limit signal indicator according to claim 15 wherein the limit signal indicator has positioning parameters and wherein an operating element is provided that is actuated by an operation person in order to adjust the positioning parameters for the limit signal indicator at the microprocessor.

21. The limit signal indicator according to claim 20 wherein a further microprocessor is provided disposed between the operating element and the microprocessor.

22. The limit signal indicator according to claim 15 wherein an enclosed housing is provided in which an electro-pneumatic I/P converter along with the microprocessor are enclosed, an electrical input connected to the microprocessor, a pneumatic input of the electro-pneumatic I/P converter connected to a pneumatic source, and a pneumatic output of the electro-pneumatic I/P converter connected to said positioning drive.

23. The limit signal indicator according to claim 15 wherein an electro-pneumatic I/P converter is provided having an electrical input for detecting a voltage signal generated by the microprocessor, the detected voltage signal indicating an operational state of the I/P converter, the detected voltage signal being visualized on a display at an outside of the limit signal indicator, and said converter having a pneumatic output connected to said positioning drive and a pneumatic input connected to a pneumatic source.

24. The limit signal indicator according to claim 15 wherein the microprocessor, for differentiating at least one of the first and second emergency signals, clocks the at least one emergency signal in a frequency specific manner so that the at least one emergency signal is identifiable with respect to a detected operational malfunctioning.

25. The limit signal indicator according to claim 15 wherein the first, the second, and the third signal transmission contacts each comprises a Namur sensor.

26. A method for operating a limit signal indicator for determining first and second positions of a pneumatically operated positioning device actuated by a positioning drive, comprising the steps of:

detecting a position of the positioning device with a position sensor;

outputting from a first signal transmission contact a first electrical limit position signal indicating that the position device is in the first or the second position and outputting a second electrical limit position signal different than said first electrical limit position signal at a second signal transmission contact indicating that the positioning device is in the first or the second position, or indicating with the first and the second electrical limit position signals a position of the positioning device different than the first and the second positions;

transmitting based on a transmission malfunction signal at said first signal transmission contact a first emergency signal to an external processing location in case of a signal transmission malfunctioning within the limit signal indicator; and upon detecting by a microprocessor a specific operational malfunctioning of the limit signal indicator, the positioning device, or the positioning drive, or a combination thereof, said specific operational malfunctioning being other than said signal transmission malfunctioning, executing with said microprocessor an emergency procedure according to which a second emergency signal based on a specific malfunction signal at said second signal transmission contact is transmitted to said external processing location.

27. A method for operating a limit signal indicator for determining first and second positions of a pneumatically operated positioning device actuated by a positioning drive, comprising the steps of:

detecting a position of the positioning device with a position sensor;

outputting from a first signal transmission contact the first electrical limit position signal indicating that the position device is in the first or the second position and outputting a second electrical limit position signal different than said first electrical limit position signal at a second signal transmission contact indicating that the positioning device is in the first or the second position, or indicating with the first and the second electrical limit position signals a position of the positioning device different than the first and the second positions;

transmitting based on a transmission malfunction signal at said first signal transmission contact a first emergency signal to an external processing location in case of a signal transmission malfunctioning within the limit signal indicator;

upon detecting by a microprocessor a first specific operational malfunctioning of the limit signal indicator, the positioning device, or the positioning drive, or a combination thereof, said first specific operational malfunctioning being other than said signal transmission malfunctioning, executing with said microprocessor a first emergency procedure according to which a second emergency signal based on a first specific malfunction signal at said second signal transmission contact is transmitted to said external processing location; and upon detecting by said microprocessor a second specific operational malfunctioning of the limit signal indicator, the positioning device, or the positioning drive, or a combination thereof, said second specific operational malfunctioning being other than said signal transmission malfunctioning, executing with said microprocessor a second emergency procedure according to which a third emergency signal based on a second specific malfunction signal at a third signal transmission contact is transmitted to said external processing location.

28. A limit signal indicator for determining first and second positions of a pneumatically operated positioning device actuated by a positioning drive, comprising:

a position sensor for detecting a position of the positioning device;

a first signal transmission contact, a second signal transmission contact, and a microprocessor connected to the first and second contacts by respective communication lines;

the first signal transmission contact outputting a first electrical limit position signal indicating that the positioning device is in the first or the second position and the second signal transmission contact outputting a second electrical limit position signal different than said first electrical limit position signal indicating that the positioning device is in the first or the second position, or the first and the second electrical limit position signals indicating a position of the positioning device different than the first and the second positions;

a transmission malfunction signal at said first signal transmission contact being used to transmit to an external processing location a first emergency signal in case of a signal transmission malfunctioning within the limit signal indicator; and upon detecting by said microprocessor a specific operational malfunctioning of the limit signal indicator, the positioning device, or the positioning drive, or a combination thereof, said specific operational malfunctioning being other than said signal transmission malfunctioning, said microprocessor executing an emergency procedure according to which a second emergency signal based on a specific malfunction signal at said second signal transmission contact is transmitted to said external processing location.

29. A limit signal indicator for determining first and second positions of a pneumatically operated positioning device actuated by a positioning drive, comprising:

a position sensor for detecting a position of the positioning device;

a first signal transmission contact, a second signal transmission contact, a third signal transmission contact, and a microprocessor connected to the first, second, and third contacts by respective communication lines;

the first signal transmission contact outputting a first electrical limit position signal indicating that the positioning device is in the first or the second position and the second signal transmission contact outputting a second electrical limit position signal different than said first electrical limit position signal indicating that the positioning device is in the first or the second position, or the first and the second electrical limit position signals indicating a position of the positioning device different that the first and the second positions;

a transmission malfunction signal at said first signal transmission contact being used to transmit to an external processing location a first emergency signal in case of a signal transmission malfunctioning within the limit signal indicator;

upon detecting by said microprocessor a first specific operational malfunctioning of the limit signal indicator, the positioning device, or the positioning drive, or a combination thereof, said first specific operational malfunctioning being other than said signal transmission malfunctioning, said microprocessor executing a first emergency procedure according to which a second emergency signal based on a first specific malfunction signal at said second signal transmission contact is transmitted to said external processing location; and upon detecting by said microprocessor a second specific operational malfunctioning of the limit signal indicator, the positioning device, or the positioning drive, or a combination thereof, said second specific operational malfunctioning being other than said signal transmission malfunctioning, said microprocessor executing a second emergency procedure according to which a third emergency signal based on a second specific malfunction signal at said third signal transmission contact is transmitted to said external processing location.

* * * * *